US011130611B2

(12) United States Patent
Holdsworth

(10) Patent No.: US 11,130,611 B2
(45) Date of Patent: Sep. 28, 2021

(54) SELF-CONTAINED CONTINUOUS CARTON SYSTEM WITH SELF ERECTING STACKING SHOULDERS

(71) Applicant: James Kenneth Holdsworth, Medford, NJ (US)

(72) Inventor: James Kenneth Holdsworth, Medford, NJ (US)

(73) Assignee: E-Z Set, LLC, Medford, NJ (US)

( * ) Notice: Subject to any disclaimer, the term of this patent is extended or adjusted under 35 U.S.C. 154(b) by 0 days.

(21) Appl. No.: 16/518,514

(22) Filed: Jul. 22, 2019

(65) Prior Publication Data

US 2020/0024028 A1 Jan. 23, 2020

Related U.S. Application Data

(60) Provisional application No. 62/701,129, filed on Jul. 20, 2018.

(51) Int. Cl.

| | |
|---|---|
| ***B65D 5/42*** | (2006.01) |
| ***B65D 5/02*** | (2006.01) |
| ***B65D 5/64*** | (2006.01) |
| ***B65D 5/00*** | (2006.01) |

(52) U.S. Cl.

CPC ..... *B65D 5/4204* (2013.01); *B65D 5/001* (2013.01); *B65D 5/0227* (2013.01); *B65D 5/0281* (2013.01); *B65D 5/4266* (2013.01); *B65D 5/64* (2013.01)

(58) Field of Classification Search

CPC ..... B65D 5/0281; B65D 5/443; B65D 5/001; B65D 5/0227; B65D 5/0245; B65D 5/5007; B65D 2571/00259; B65D 2571/00895; B65D 71/18

USPC ..... 229/166, 167, 915, 191, 103.2; 206/508, 206/509

See application file for complete search history.

(56) References Cited

U.S. PATENT DOCUMENTS

| | | | | |
|---|---|---|---|---|
| 3,310,219 A * | 3/1967 | Dlugopolski | B65D 5/6661 | 229/117.12 |
| 4,573,633 A * | 3/1986 | Brian | B65D 5/22 | 229/167 |
| 5,544,806 A * | 8/1996 | Anderson | B65D 5/2019 | 206/453 |
| 6,675,970 B1 * | 1/2004 | Nemoto | B65D 5/5021 | 206/521 |

(Continued)

FOREIGN PATENT DOCUMENTS

| | | |
|---|---|---|
| JP | 01267151 A * | 10/1989 |
| JP | 05162741 A * | 6/1993 |

*Primary Examiner* — Nathan J Newhouse
*Assistant Examiner* — Phillip D Schmidt
(74) *Attorney, Agent, or Firm* — Dunlap Bennett & Ludwig, PLLC; Brendan E. Squire

(57) ABSTRACT

A self-contained continuous PDQ package system is provided for shipment and display of products. The PDQ package includes four adjacent sections of preferably corrugated material each with an inner facing and an outer facing surface, with a cut out within the bottom flap panel. Within the cut out, there is a section where an adhesive is placed adhering the inner facing portion of body panel and the inner facing of a section of bottom of the outer panel flap and adjacent mid-section panel. The self-contained continuous PDQ package system also provides an erectable reinforced shoulder to facilitate display of products in a stack of cartons.

14 Claims, 9 Drawing Sheets

(56) References Cited

U.S. PATENT DOCUMENTS

| | | | | |
|---|---|---|---|---|
| 8,794,435 | B1 * | 8/2014 | Marini | B31B 50/26 206/278 |
| 9,957,085 | B2 * | 5/2018 | Bourdin | B65D 21/0212 |
| 2003/0141356 | A1 * | 7/2003 | Sheffer | B65D 5/16 229/164 |
| 2008/0078821 | A1 * | 4/2008 | Keefe | B65D 5/18 229/167 |
| 2015/0068945 | A1 * | 3/2015 | Baker | B65D 5/0015 206/509 |

* cited by examiner

SELF-CONTAINED CONTINUOUS CARTON SYSTEM WITH SELF ERECTING STACKING SHOULDERS

CROSS-REFERENCE TO RELATED APPLICATION

This application claims the benefit of priority of U.S. provisional application No. 62/701,129, filed Jul. 20, 2018, the contents of which are herein incorporated by reference.

BACKGROUND OF THE INVENTION

The present invention relates to dual function shipping and display corrugated packages, referred to as PDQ's (pretty darn quick), and more particularly to continuous PDQ's. These PDQ's serve for shipment of goods and convert to display the goods in retail environments.

Current glued designs for PDQ's require adding an additional fifth panel to the side flaps which is adhered to the bottom flaps. Because there is no structural support between the outer and inner side walls of the carton, there is a high probability of inner wall deflection/imploding when subjected to the weight of packages stacked on top. This adds stress to the front lip of the box which in turn kinks, causing additional imploding of the side walls, as seen in reference to FIGS. 6,7, 8 and 9. Non-glued PDQ designs also existing with similar issues, which either are not addressed or additional costly reinforcement components are added. These require additional assembly and are less sustainable.

The results can be product damage, restricted access to product, requirement to repack/restack the product on store shelves or endcaps to make the goods more presentable on the sales floor. Current PDQ packages also present safety concerns as the pallet of product is not stable and can collapse or topple over. This can be very problematic when placing in or removing from warehouse storage racks.

As can be seen, there is a need for an improved continuous PDQ that provides significant reduction/elimination of inner side wall deflection/implosion and front lip kinking. This makes the pallet more stable. It also uses less material as it is not adhered to the bottom flaps which makes it a lower cost and more sustainable.

SUMMARY OF THE INVENTION

In one aspect of the present invention, a carton is disclosed having a plurality of sidewall sections, a bottom defining an interior compartment, and a top opening. The carton includes a shouldered section having an outer sidewall and a shoulder tab extending from the outer sidewall along a top fold line. A shoulder fold line is defined in the shoulder tab in a spaced apart relation from the top fold line. When the shoulder tab is folded inwardly along the top fold line and the shoulder fold line to extend into the interior compartment, a top shoulder surface is interposed between the outer sidewall and the shoulder tab.

In other embodiments, the shouldered sidewall includes a bottom tab extending from the outer sidewall along a bottom fold line. The bottom tab is configured to form at least a portion of the bottom of the carton when folded along the bottom fold line. A folding recessed truss interconnects a lower end of the outer sidewall and the bottom tab, wherein the folding recessed truss forms a truss structure between the outer sidewall and the shoulder tab when the bottom tab is folded.

In other embodiments, a vertical truss kick in is attached to the bottom tab along a lower truss fold line that is offset from the bottom fold line by a distance corresponding to a width of the top shoulder surface. A horizontal truss tab has a lower attachment to the vertical truss kick in along an intermediate truss fold line. The intermediate truss fold line is offset from the lower truss fold line by a distance corresponding to the width of the top shoulder surface.

In other embodiments, an upper attachment of the horizontal truss tab to the outer sidewall is provided along an upper truss fold line. The upper truss line is offset from the bottom fold line by a distance corresponding to the width of the top shoulder surface.

In yet other embodiments, when the bottom tab is folded inwardly from the outer sidewall, the vertical truss kick in is positioned in abutment with an outwardly facing surface of the shoulder tab and the horizontal truss kick in spans a gap between the sidewall and the shoulder tab.

Other aspects of the invention include a carton formable from a unitary sheet of die cut material defining a plurality of interconnected sections. The carton includes a first shoulder section, a front access section, a second shouldered section, and a back wall section. One of the front access section or the back wall section are interposed between the first shoulder section and the second shoulder section. A vertical fold line is defined between adjacent sections of the plurality of interconnected sections. A bottom tab extends from a bottom fold line defined along an outer sidewall of each the plurality of interconnected sections. The bottom tab forms a portion of a bottom to the carton when folded along the bottom fold line. An interior tab extends from a top fold line defined along an opposite edge of the outer sidewall of each of the plurality of interconnected sections. A shoulder fold line is defined in each interior tab of the first shoulder section and the second shoulder section. The shoulder fold line is off set from the top fold line by a distance corresponding to a desired width of a top shoulder surface positioned at a top end of the shoulder section. A folding recessed truss interconnects a lower end of the outer sidewall, the bottom tab, and is attached to an inner face of the interior tab of the first shoulder section and the second shoulder section. The folding recessed truss forms a truss structure between the outer sidewall and the interior tab of the first shoulder section and the second shoulder section when the bottom tab of the first shouldered section and the second shoulder section are folded inwardly about the bottom fold line.

In other embodiments, a joining tab extends from a first end of the plurality of interconnected sections, the joining tab configured to be attached to a second end of the plurality of interconnected sections. An offset cut may be defined in a side edge of the interior tab.

In other embodiments, the interior tab is configured to fold inwardly about the top fold line so that the interior tab is positioned parallel to an interior face of a corresponding outer sidewall.

In yet other embodiments, a vertical truss kick in is attached to the bottom tab along a lower truss fold line that is offset from the bottom fold line by a distance corresponding to a width of the top shoulder surface. A horizontal truss tab has a lower attachment to the vertical truss kick in along an intermediate truss fold line that is offset from the lower truss fold line by a distance corresponding to the width of the top shoulder surface. An upper attachment of the horizontal truss tab to the outer sidewall is provided along an upper truss fold line that is offset from the bottom fold line by a distance corresponding to the width of the top shoulder surface.

When the bottom tab is folded inwardly from the outer sidewall, the vertical truss kick in urges the inner face of the interior tab of each of the first shouldered section and the second shoulder section inwardly to position the interior tab in a spaced apart relation from the outer sidewall by a width corresponding to the width of the top shoulder surface.

These and other features, aspects and advantages of the present invention will become better understood with reference to the following drawings, description and claims.

DETAILED DESCRIPTION OF THE INVENTION

Figure 1:
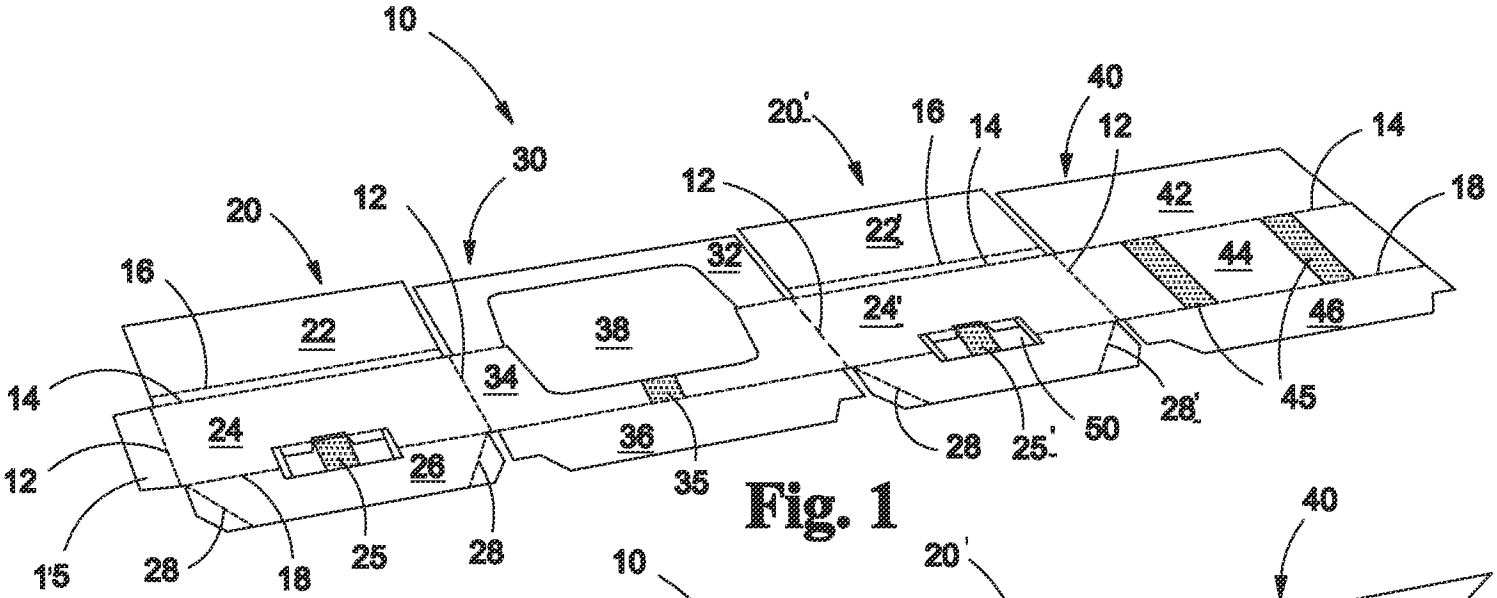
FIG. 1 is an interior perspective view of a first embodiment of self-contained continuous carton system (SC3S) laid out flat.
Figure 2:
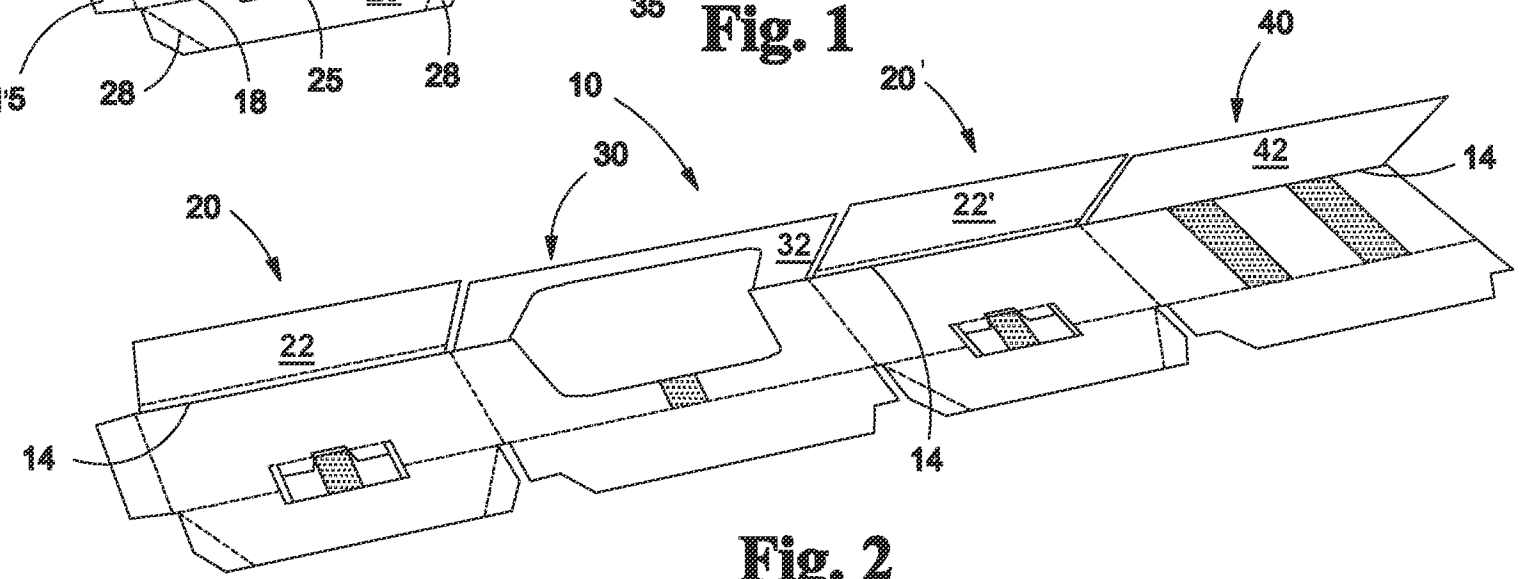
FIG. 2 is an interior perspective view of the SC3S showing a first folding step.
Figure 3:
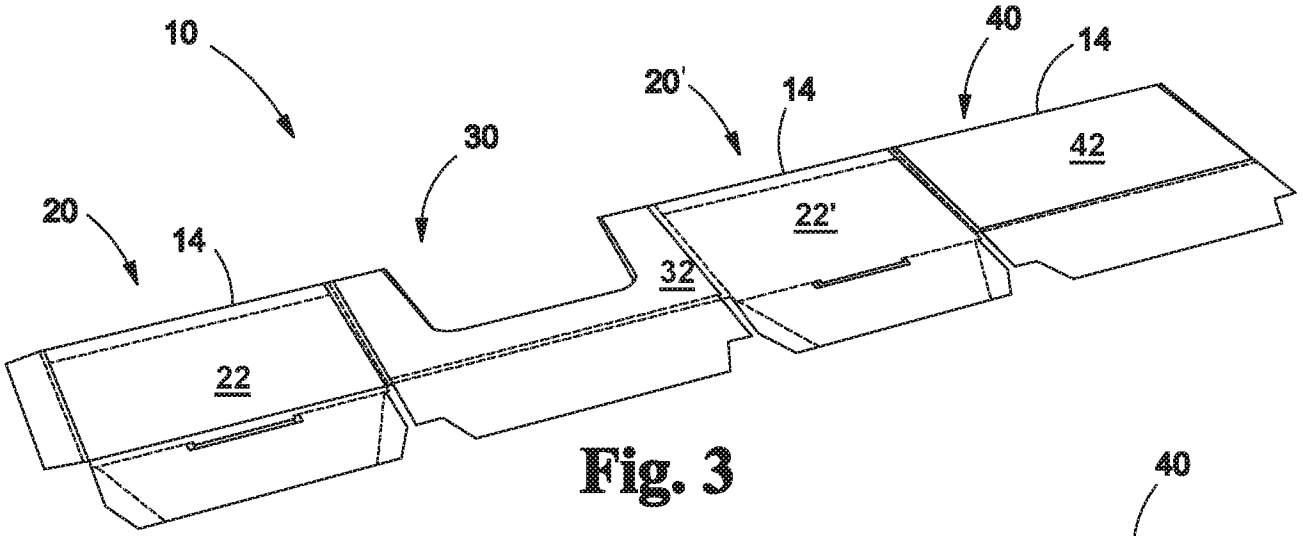
FIG. 3 is an interior perspective view of the SC3S showing the first folding state for fastening interior tab 22, 32, 22', 42 to the outer sidewall 24, 34, 24', 44.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, embodiments of the present invention provide an improved self-contained continuous carton system with erecting reinforced shoulders. The invention provides a dual purpose PDQ providing structural integrity withstanding the rigors of the entire supply chain and as well as a display vehicle. The reinforced shoulders to support stacking of one or more additional cartons on top of the reinforced shoulders to significantly reduce the incidence of the shoulders collapsing or buckling. A side panel of the self-contained continuous carton system also creates an alcove with a secondary purpose as a hand hold facilitates carriage and stacking of the carton by warehouse and stocking workers.

In a first non-limiting embodiment of the present invention shown in reference to FIGS. 1-15, the self-contained continuous carton system (SC3S) 10 includes four adjacent sections, preferably formed of a corrugated material, such as cardboard. The SC3S 10 includes: a first shoulder section 20, a front access section 30, a second shouldered section 20', and a back wall section 40. Each of the sections are defined by a die cut and a plurality of fold lines which are conveniently folded to automatically form the shouldered carton SC3S 10. The SC3S 10 also includes a lid 100 to further protect and contain articles in the SC3S 10 throughout the logistics chain. The sequence of the sections may be rearranged from that shown, provided that one of the front access section 30 or the back wall section 40 are interposed between the first shoulder section 20 and the second shoulder section 20'.

A vertical fold line 12 is defined between adjacent, interconnected sections. A joining tab 15 is provided at a first end of the SC3S 10 and a vertical fold line 12 is defined between a section at the first end and. A fastener, such as an adhesive, staple, or adhesive tape (indicated by the stippled areas in the drawings) may be applied to the joining tab 15 so that it may be joined to a section at a second end of the SC3S 10 when the sections are formed in the shape of a carton.

A top fold line 14 is defined across a top end of each of the interconnected sections between an interior tab 22, 32, 22', and 42 and a corresponding outer sidewall panel 24, 34, 24', 44 of each section. The interior tab 22, 32, 22', 42 of each section is folded along the top fold line 14 such that the interior tabs 22, 32, 22', 42 are positioned parallel to an interior face of the corresponding outer sidewall 24, 34, 24', 44. Each interior tab 22, 32, 22', 42 may also include an offset cut so that a side edge of the interior tab 22, 32, 22', 42 is positioned away from an extension of its corresponding vertical fold line 12, such that the corresponding interior tab 22, 32, 22', 42 may be folded and received within an interior cavity of the SC3S 10 without binding with the adjacent sidewalls 24, 34, 24', 44.

A bottom fold line 18 is defined at a bottom end of each of the interconnected sections between a bottom tab 26, 36, 26', 46 and the sidewall 24, 34, 24', 44. The bottom tab 26, 36, 26', 46, when folded along the bottom fold line 18 cooperate to form a bottom wall of the SC3S 10. The bottom tab 26, 36, 26', 46 may then be joined with one or more of an adhesive, a staple, or an adhesive tape.

Each of the first shoulder panel 20 and the second shoulder section 20' also include a shoulder fold line 16 defined on the interior tabs 22, 22', which may also be referred to as shoulder tabs 22, 22'. The shoulder fold line 16 is formed parallel to and spaced apart from the top fold line 14 by a desired shoulder dimension. A remaining length of the shoulder tab 22, 22' is dimensioned to correspond to a height of the sidewall 24, 24', that is, the spacing between the top fold line 14 and the bottom fold line 18. When folded inwardly about each of the top fold line 14 and the shoulder fold line 16 and the shoulder tab 22, 22' are positioned within the interior cavity of the SC3S 10 parallel to sidewalls 24, 24', the shoulder tab 22, 22' define a shoulder surface 27 along opposed sides of a top opening of the SC3S 10.

The front access section 30 may include an access cutout 38 defined in each of the inner tab 32, or access tab, and the sidewall 34 of the front access section. When the cutout tab 32 is folded inwardly along the top fold line 14 and placed in abutment with an inner face of the front sidewall 34, the access cutout 38 provides a large opening in the front of the SC3S 10 so that goods carried within the SC3S 10 may be viewed and grasped by a shopper. The cutout tab 32 may be secured to an interior face of the front sidewall at a fastening point 35, via an adhesive, staple, or adhesive tape.

Each shoulder section 20, 20' may also be provided with a folding recessed truss 50 which provides a structural support truss between the sidewall 24, 24 of the shoulder section 20, 20' and the shoulder tab 22, 22' when folded inwardly to form the shoulders of the SC3S 10. The folding recessed truss 50 also provides a convenient hand hold for carrying or manipulating the SC3S 10.

As best seen in reference to FIGS. 23-25*b*, the folding recessed truss 50 includes a vertical truss kick in 52 extending along a lower truss fold line 58 of the folding recessed truss 50. The vertical truss kick in 52 is interconnected to the sidewall 24 via a horizontal truss tab 56 that form along an intermediate truss fold line 53, when the bottom tab 26 is folded inwardly.

The lower truss fold line 58 is off set from the bottom fold line 18 of the bottom tab 26 by a distance corresponding to the width of the shoulder dimension. Likewise, the intermediate truss fold line 53 is defined below the upper truss fold line 55 by a distance corresponding to the width of the shoulder dimension, such that when folded, the vertical truss kick in 52 is positioned in abutment with an outwardly facing surface the shoulder tab 22, 22' and the horizontal truss kick in 56 spans between the sidewall 24 and the shoulder tab 22, 22'. An inwardly facing surface of the vertical truss kick-in 52 may be joined to the shoulder tab 22, 22' by a fastener, such as an adhesive or a staple.

In some embodiments, the vertical truss kick-in 52 has a protrusion and the horizontal truss kick in 56 has a corresponding notch. A section within the plane of the intermediate truss fold line 53 that does not have a score running horizontally through it. The absence of the fold line at this portion creates a continuous section of un-scored corrugated within a left and a right horizontal truss kick in 56, providing added structural strength to the shoulder section 20. This section is straddled by the intermediate truss fold line 53 on the left and right of said section of un-scored corrugated material. The area above the intermediate truss fold line 53 becomes a tab where an adhesive or fastener is applied to the inner facing of the tab and inner facing of the sidewall 24.

When the bottom tabs 26 are folded inwardly approaching 90 degrees, the scored and adhered area within the die cut folds inwardly towards the center of the structure creating an alcove, including horizontal and adjacent vertical panels within the confines of the die cut section. Accordingly, a reinforced truss is formed automatically on the bottom of the shoulder section 20, 20' between the inner and outer walls of the shoulder structure. This area has two purposes. First the folding truss recess 50 reinforces the shoulder tab 22 preventing the shoulder tab 22, 22' from imploding/collapsing. Second, the folding truss recess 50 provides a handhold for easier access lifting, carrying and stacking the PDQ, often weighing up to 40 lbs. when full of goods.

In use the SC3S 10 may be used for shipment and display of goods in almost any retail environment where packages, preferably of the same size footprint, are stacked on top of each other. The SC3S 10 is also an ideal solution for any manufacturer whose customers require their packaging to withstand the rigors of a demanding supply chain, such as but not limited to club stores.

The SC3S 10 is manufactured to survive: warehouse exposure to elements, such as high humidity; transcontinental and intercontinental transport to retailer distribution centers; and transit or storage environments where pallets of other vendor product may be stacked on top other theirs. The product stacked on top could substantially outweigh their product.

Figure 4:
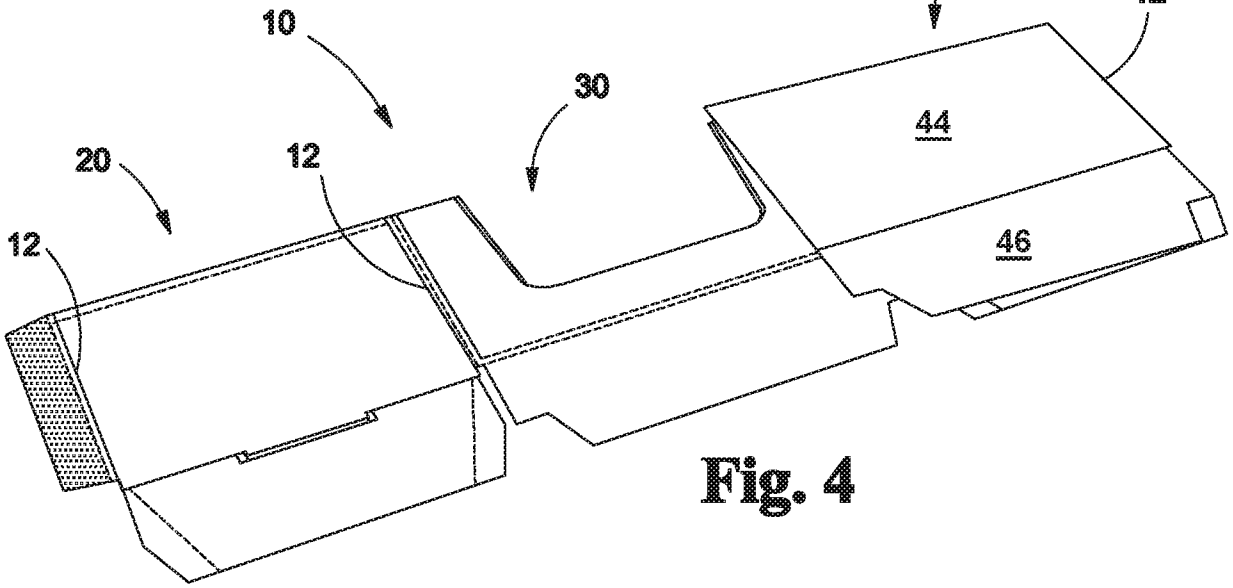
FIG. 4 is an interior perspective view showing a first fold about a vertical fold line 12.
Figure 7:
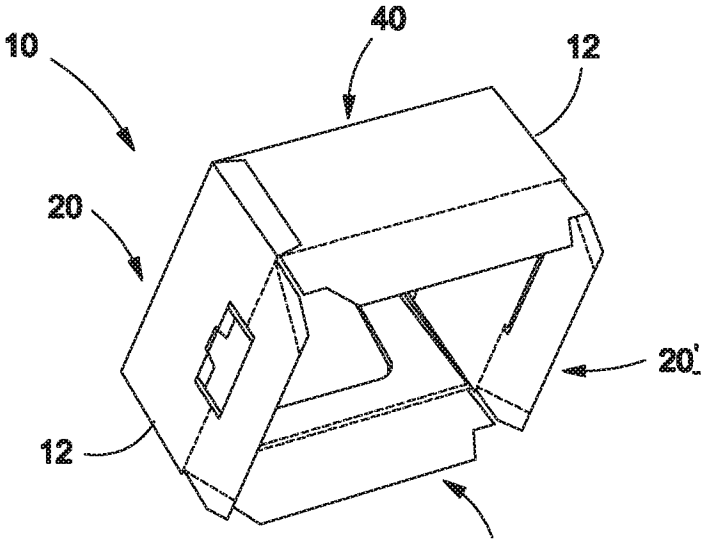
FIG. 7 is a perspective view of the SC3S expanded to form a box shape.
Figure 5:
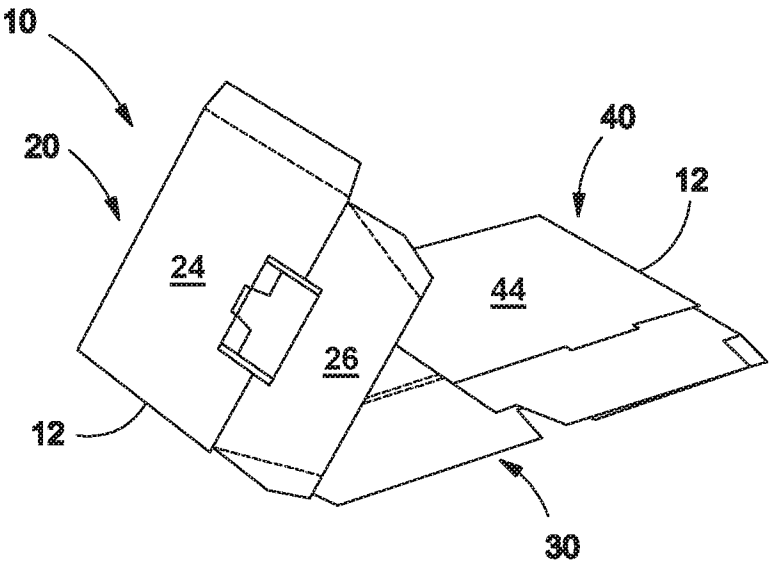
FIG. 5 is an interior perspective view showing a second fold about a vertical fold line 12.
Figure 6:
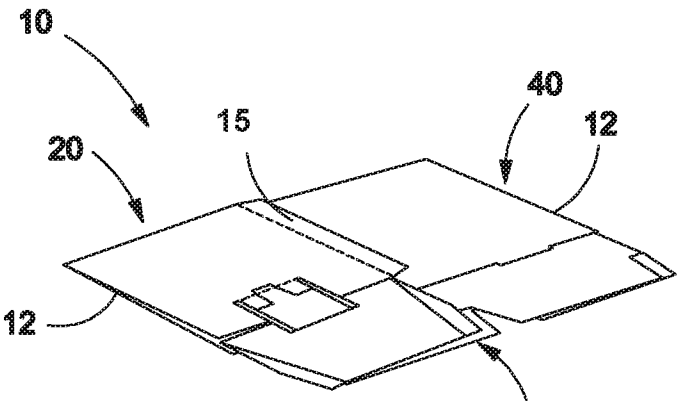
FIG. 6 is a perspective view of the SC3S showing the folding state for fastening joining tab 15 to an end sidewall.
Figure 11:
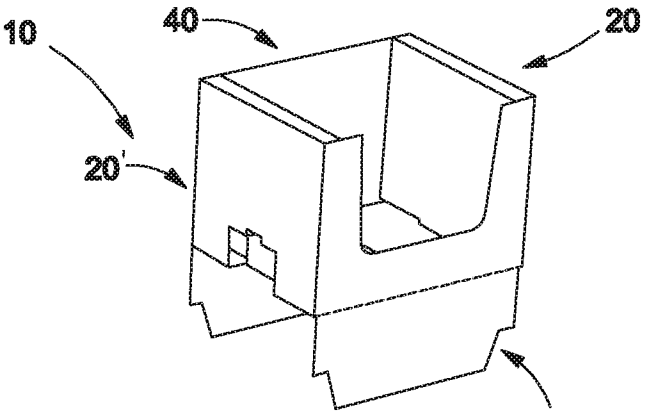
FIG. 11 is a front perspective view of the SC3S with a second bottom tab 26' folded to form a truss recess 50'.
Figure 12:
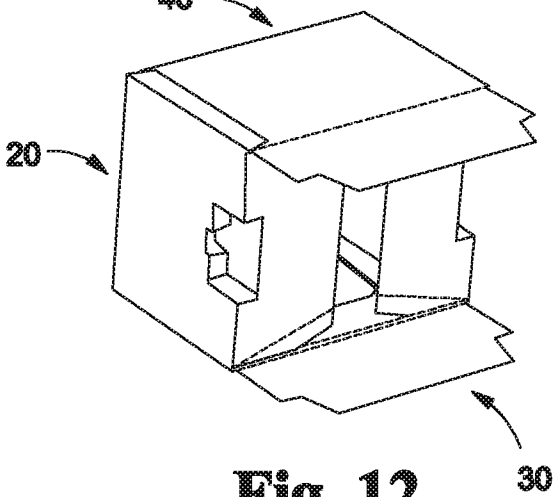
FIG. 12 is a bottom perspective view of the SC3S positioned to complete formation of the bottom.
Figure 9:
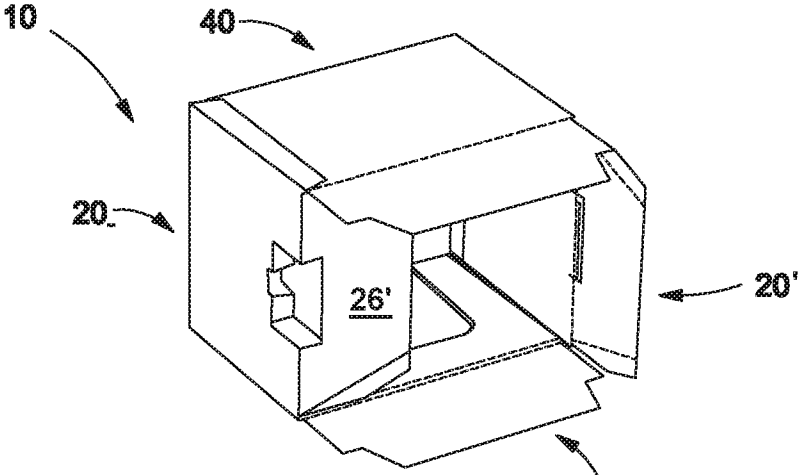
FIG. 9 is a rear perspective view of the SC3S with a first bottom tab 26 folded to form a folding truss recess 50.
Figure 10:
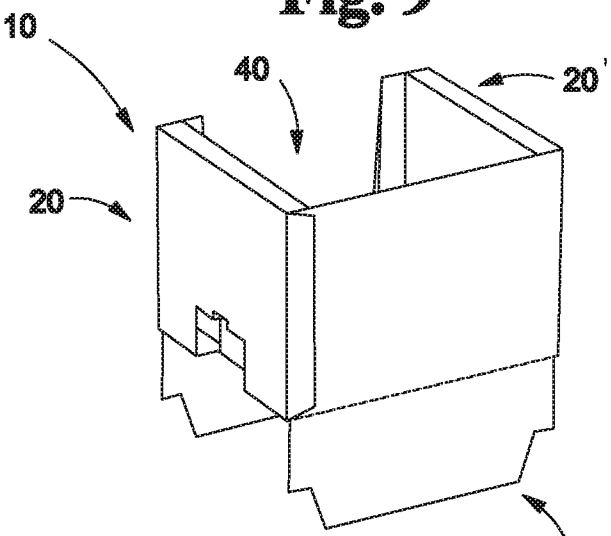
FIG. 10 is a bottom perspective view the SC3S with the first bottom tab 26 folded to form the first truss recess.

A method of assembling the self-contained continuous carton system is shown in reference to FIGS. 2-15. In a first step shown in reference to FIGS. 2 and 3, the interior tab 22, 32, 22', 42 is folded about top fold line 14 and secured to their corresponding sidewall 24, 34, 24', 44 via a fastener, such as an adhesive or a staple at the corresponding fastening points 25, 35, 25', and 45. Next the back section 40 is folded about vertical fold line 12 and laid across its adjacent second shoulder section 20', as seen in FIG. 4. Referring now to FIG. 5, the first shoulder section 20 is then folded about the vertical fold line 12 interposed between the first shoulder section 20 and the front access section 30. The joining tab 15 is then secured to interconnect the first end of the SC3S 10 and the second end of the SC3S 10 as shown in reference to FIG. 6.

Figure 8:
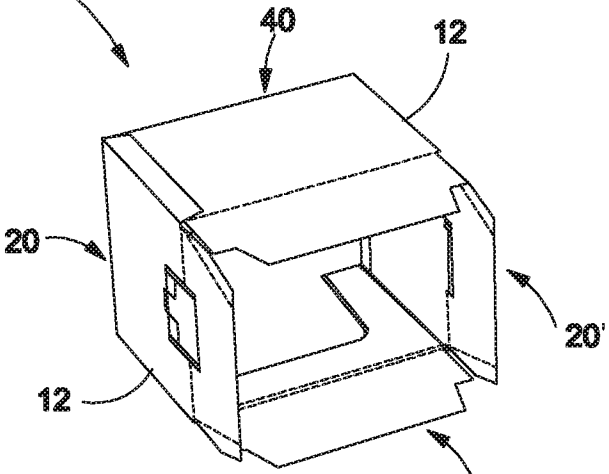
FIG. 8 is a bottom perspective view of the SC3S positioned to form the bottom of the SC3S.

As seen in reference to FIG. 8, the SC3S 10 is then manipulated to a rectangular configuration defining the interior cavity. The bottom tabs 26, 26' of the shouldered section 20, 20' are folded inwardly along the bottom fold lines 18. Turning now in reference to FIGS. 9-12, as the bottom tab 26, 26' is folded inwardly the folding recessed truss 50 is automatically formed in the respective shoulder section 20, 20'.

Figure 14:
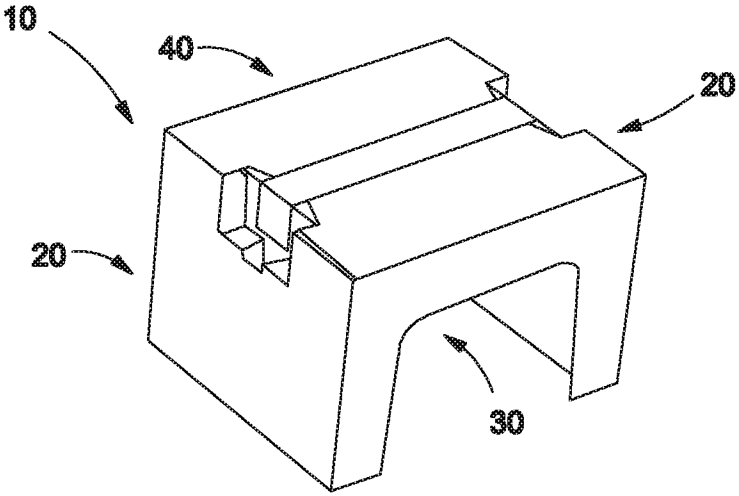
FIG. 14 is a bottom perspective view showing a bottom tab 36 folded, and a fastener to secure the formed bottom.
Figure 15:
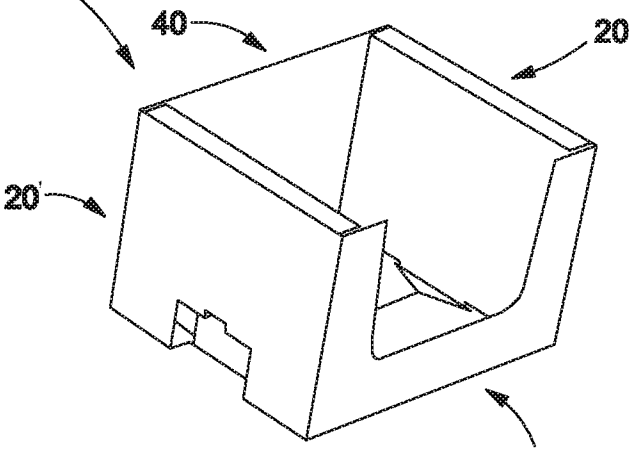
FIG. 15 is a top front perspective view of the SC3S showing the shouldered sidewalls and folding truss recess 50.
Figure 13:
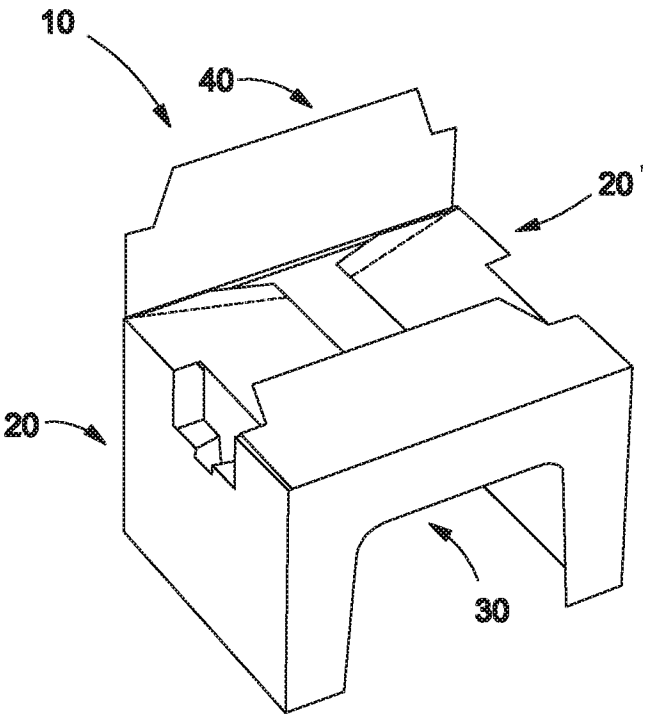
FIG. 13 is a bottom perspective view showing a bottom access tab 46 folded.
Figure 18:
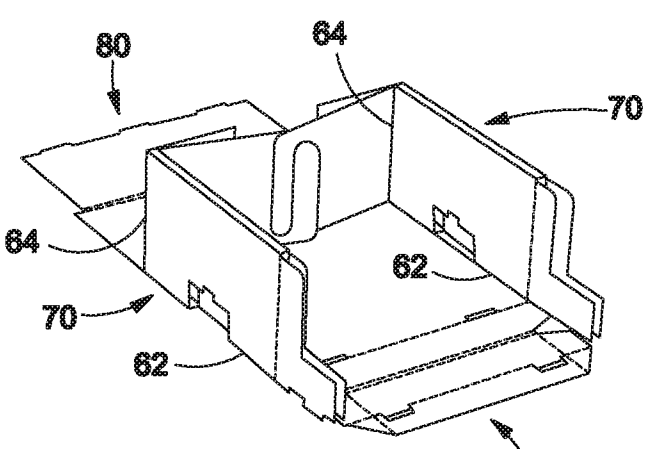
FIG. 18 is a front perspective view of the SC3S folding of a shoulder joining tab along a transverse fold line 64, and with lobes 76 interlocked.
Figure 19:
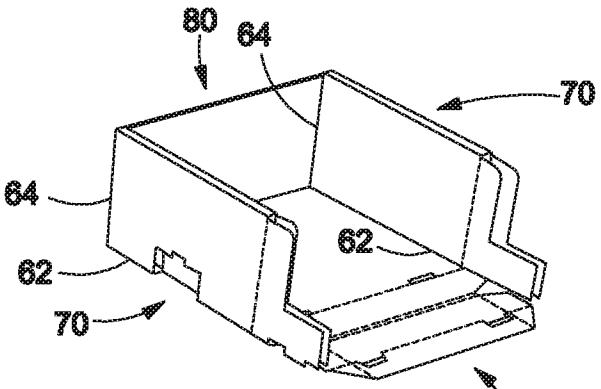
FIG. 19 is a front perspective view of an aft sidewall panel folded to form an aft sidewall.
Figure 16:
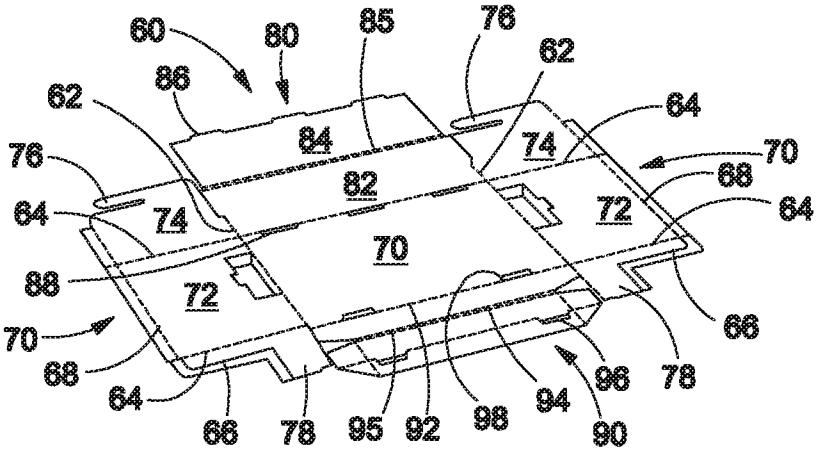
FIG. 16 is an interior perspective view of a second embodiment of the SC3S laid out flat.
Figure 17:
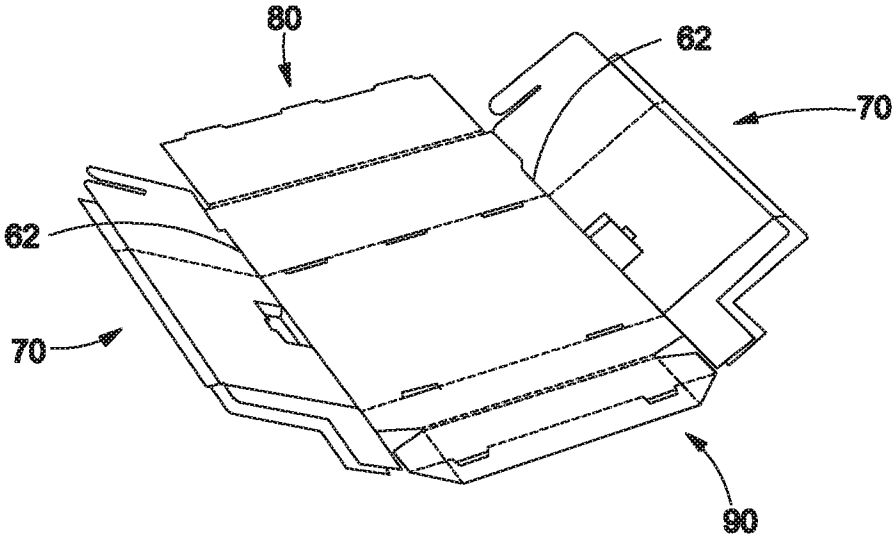
FIG. 17 is an interior perspective view of the second embodiment of the SC3S folded along a fore-aft fold line 62.
Figure 22:
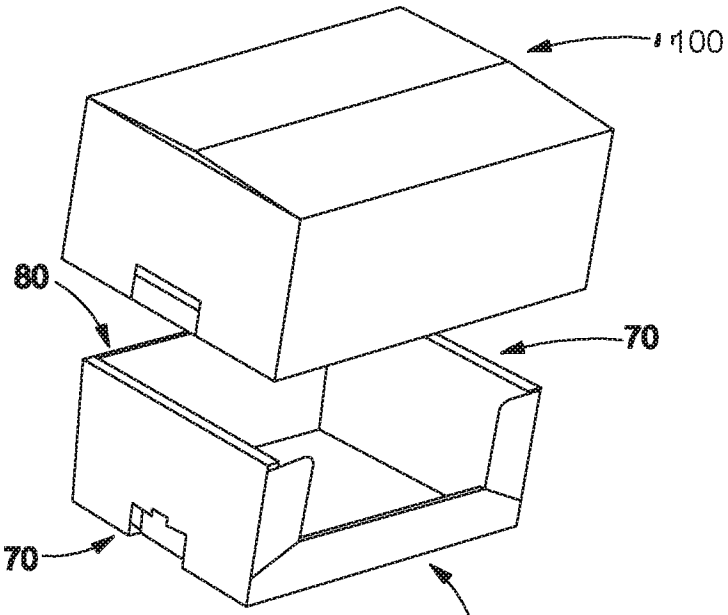
FIG. 22 is a front perspective view of the second embodiment of the SC3S base with a lid common to the first and second embodiments of the SC3S.
Figure 20:
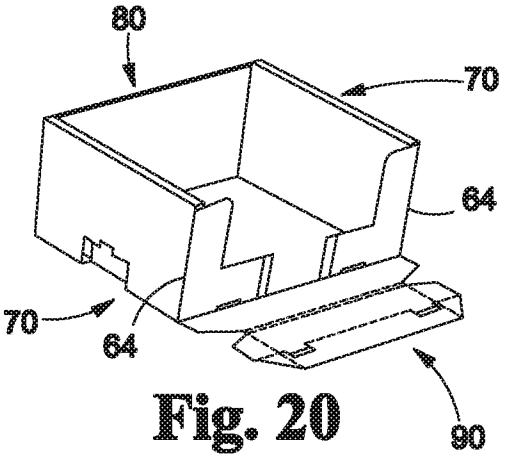
FIG. 20 is a front perspective view of the SC3S folding a front access panel wall.
Figure 21:
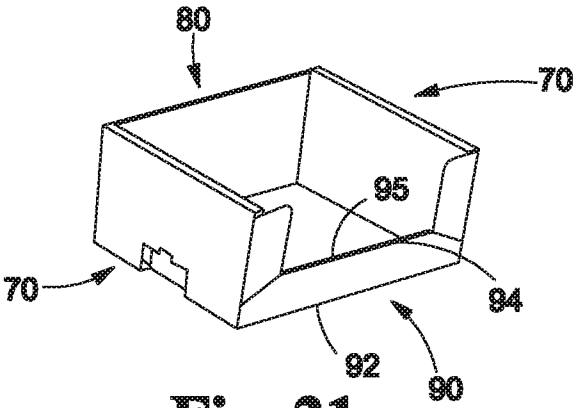
FIG. 21 is a front perspective view the completed second embodiment of SC3S base.
Figure 25A:
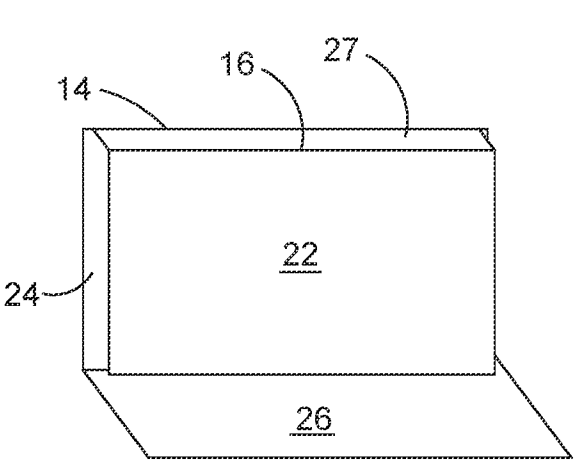
FIG. 25*a* is a detail interior view of an interior view of the shoulder section 20 in its erected position.
Figure 25B:
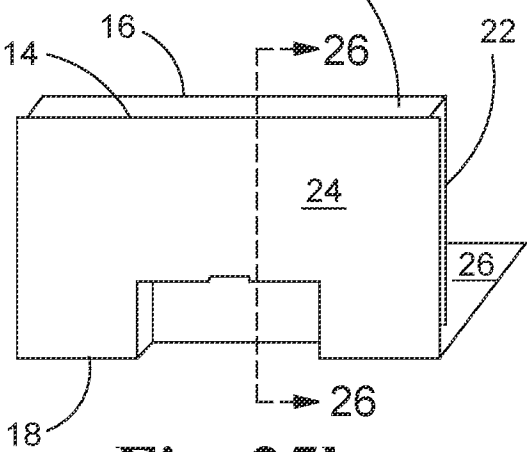
FIG. 25*b* is a detail exterior view of the shoulder section 20 in its erected position.
Figure 24:
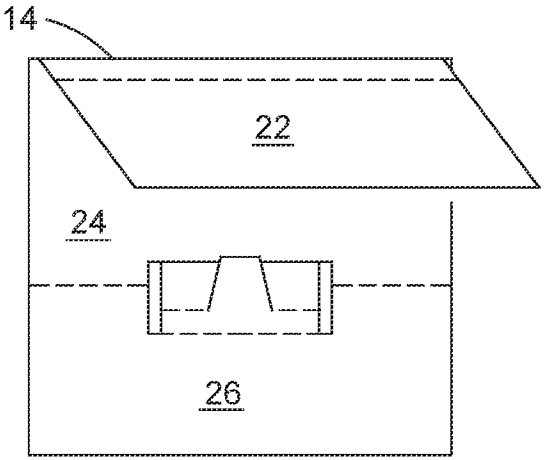
FIG. 24 is a detail view of the shoulder section 20 with an interior tab 22 being folded about the top fold line 14.
Figure 25:
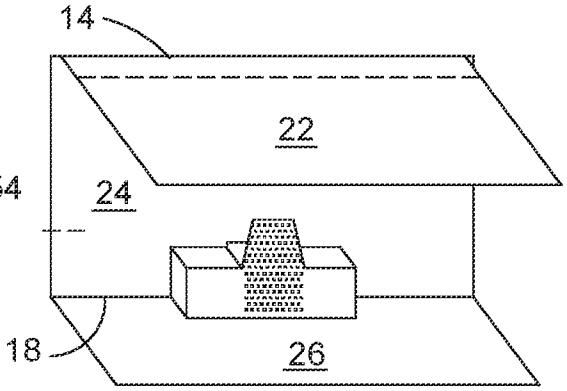
FIG. 25 is a detail interior view of the shoulder section 20 in its erected position.
Figure 23:
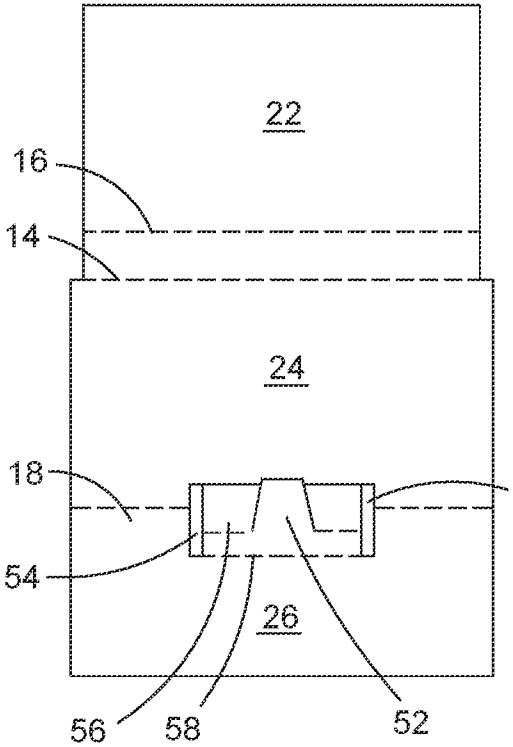
FIG. 23 is a detail view of a shoulder section 20 with a folding recessed truss 50, laid flat.
Figure 26:
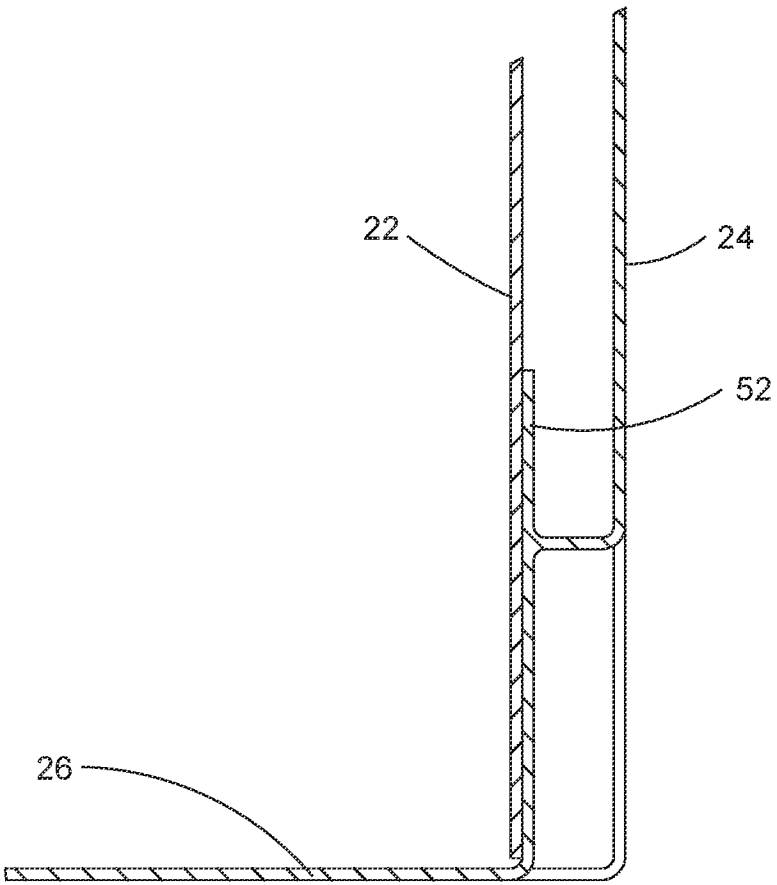
FIG. 26 is a side sectional view of the container showing the folding recessed truss taken along line 26-26 of FIG. 25*b*.

As seen in reference to FIGS. 13 and 14, the bottom tab 36, 46 of the access section 30 and the back section 40 are folded inwardly along the bottom fold line to overlap the bottom tab 26, 26' of the shoulder section 20, 20'. The bottom tabs 36, 46 may then be secured utilizing a fastener, such an adhesive, an adhesive tape, a staple, or combinations thereof. The SC3S 10 may then be inverted and is ready for filling with products to be carried therein.

In a second, non-limiting embodiment, shown in reference to FIGS. 16-22, an SC3S 60 includes a shoulder section 70, 70' extending from opposed sides of a bottom panel 65 along a fore-aft fold line 62. A back section 80 and a front, or forward access section 90 extend from opposed sides of the bottom panel 65 along a transverse fold line 64.

The shoulder section 70, 70' includes a shoulder score line 66 and 68 defined in a spaced apart relation corresponding to a width of a shoulder of the shoulder section 70, 70'. As with the preceding embodiment, the shoulder section 70, 70' includes a folding recessed truss 50 interconnecting an interior and a shoulder sidewall 72 of the shoulder section 70, 70'.

In this embodiment, the shoulder section 70, 70' may include an aft forming tab 74, with an interlocking lobe 76 and a forward forming tab 74 extending from an aft and a forward edge of the shoulder sidewall 72. The interlocking lobes 76 are configured to retain the left and the right shoulder outer sidewall 82 in an upright and erected form when joined. The forward forming tab 74 is configured to fold inwardly and define the lateral aspects of an access opening to an interior of the SC3S 10. The forward access section 90 is formed around the forming tab 74.

The aft section 80 has an outer sidewall 82 and an inner sidewall 84 joined along an aft wall fold line 85 at a distal end of the outer sidewall 82. One or more locking tabs 86 extend from a distal edge of the inner sidewall 84. The one or more locking tabs 86 are configured to be received in a corresponding one or more receiving slots 88 defined along the transverse fold line 64. To assemble the aft wall of the SC3S 10, as shown in reference to FIGS. 18 and 19, the outer sidewall 82 is folded along the transverse fold line 64 and the inner sidewall 84 is folded along the aft wall fold line 85 to wrap around the joined interlocking lobe 76 and the aft forming tab 74. The one or more locking tabs 86 are inserted into their corresponding receiving slot 88.

Likewise, the front section 90 has an outer sidewall 92 and in inner sidewall 94 joined along a forward fold line 95 at a distal end of the outer sidewall 92. One or more locking tabs 96 protrude from a distal edge of the inner sidewall 94 and are configured to be received in corresponding one or more receiving slots 96 defined the transverse fold line 64 at a forward end of the SC3S 10. As seen in reference to FIGS. 20 and 21, the outer sidewall 92 is folded along the transverse fold line 64 and the inner sidewall 94 is folded along the forward fold line 95. The one or more locking tabs 96 are inserted into the corresponding one or more receiving slots 98. As seen in reference to FIG. 22, a lid 100 may be provided to cover the contents of the SC3S 10 during transport and storage.

It should be understood, of course, that the foregoing relates to exemplary embodiments of the invention and that modifications may be made without departing from the spirit and scope of the invention as set forth in the following claims.

What is claimed is:

1. A container having a plurality of sidewall sections and a container bottom defining an interior compartment, an outer sidewall recessed cavity, and a top opening to access the interior compartment, the container comprising:

a shouldered section having an outer sidewall extending from the container bottom along a bottom fold line, and a shoulder tab extending from the outer sidewall along a top fold line and having an inner sidewall extending from the shoulder tab along a shoulder fold line; wherein when the shoulder tab is folded inwardly along the top fold line and the shoulder fold line, the shoulder fold line and the inner sidewall to extend into the interior compartment, a top shoulder surface is interposed between the outer sidewall and the shoulder tab, and a vertical truss kick-in positioned between the outer sidewall and the inner sidewall of the shoulder section, the vertical truss kick-in formed from the container bottom by a lower truss fold line and a pair of cut lines, wherein the lower truss fold line is parallel to the bottom fold line and offset from the bottom fold line, the pair of cut lines extend between the lower truss fold line and the bottom fold line, and the vertical truss kick-in is adhered to a surface of the inner sidewall using an adhesive.

2. The container of claim 1, further comprising:

a bottom tab extending from the outer sidewall along the bottom fold line, the bottom tab configured to form at least a portion of the container bottom when folded along the bottom fold line.

3. The container of claim 2, wherein the lower truss fold line is offset from the bottom fold line by a distance corresponding to a width of the top shoulder surface.

4. The container of claim 3, further comprising:

a horizontal truss kick-in having a lower attachment to the vertical truss kick-in along an intermediate truss fold line that is offset from the lower truss fold line by the distance corresponding to the width of the top shoulder surface.

5. The container of claim 4 further comprising:

an upper attachment of the horizontal truss kick-in to the outer sidewall along an upper truss fold line that is offset from the bottom fold line by the distance corresponding to the width of the top shoulder surface.

6. The container of claim 4, further wherein, when the bottom tab is folded inwardly from the outer sidewall, the vertical truss kick-in is positioned in abutment with an outwardly facing surface the shoulder tab and the horizontal truss kick-in spans a gap between the outer sidewall and the shoulder tab.

7. A container formable from a unitary sheet of die cut material defining a plurality of interconnected sections, comprising:

a first shoulder section, a front access section, a second shoulder section, and a back wall section, wherein one of the front access section or the back wall section are interposed between the first shoulder section and the second shoulder section;

a vertical fold line defined between adjacent sections of the plurality of interconnected sections;

a bottom tab extending from a bottom fold line defined along an outer sidewall of each the plurality of interconnected sections, the bottom tab forming a portion of a bottom to the container when folded along the bottom fold line;

an interior tab extending from a top fold line defined along an opposite edge of the outer sidewall of each of the plurality of interconnected sections;

a shoulder fold line defined in the interior tab of the first shoulder section and the second shoulder section, the shoulder fold line off set from the top fold line by a distance corresponding to a desired width of a top shoulder surface positioned at a top end of the first shoulder section and the second shoulder section; and a vertical truss kick-in positioned between the outer sidewall and the interior tab each of the first shoulder section and the second shoulder section, the vertical truss kick-in formed from the bottom tab by a lower truss fold line and a pair of cut lines, wherein the lower truss fold line is parallel to the bottom fold line and offset from the bottom fold line, the pair of cut lines extend between the lower truss fold line and the bottom fold line, and the vertical truss kick-in is adhered to a surface of the interior tab using an adhesive.

8. The container of claim 7, further comprising:

a joining tab extending from a first end of the plurality of interconnected sections, the joining tab configured to be attached to a second end of the plurality of interconnected sections.

9. The container of claim 7, further comprising:

an offset cut defined in a side edge of each interior tab.

10. The container of claim 7, wherein the interior tab is configured to fold inwardly about the top fold line so that the interior tab is positioned parallel to an interior face of a corresponding outer sidewall.

11. The container of claim 7, wherein the lower truss fold line is offset from the bottom fold line by the distance corresponding to a width of the top shoulder surface.

12. The container of claim 11, further comprising:

a horizontal truss kick-in having a lower attachment to the vertical truss kick-in along an intermediate truss fold line that is offset from the lower truss fold line by the distance corresponding to the width of the top shoulder surface.

13. The container of claim 12 further comprising:

an upper attachment of the horizontal truss kick-in to the outer sidewall along an upper truss fold line that is offset from the bottom fold line by the distance corresponding to the width of the top shoulder surface.

14. The container of claim 13, wherein, when the bottom tab is folded inwardly from the outer sidewall, the vertical truss kick: in urges an inner face of the interior tab of each of the first shouldered section and the second shoulder section inwardly to position the interior tab in a spaced apart relation from the outer sidewall by the distance corresponding to the width of the top shoulder surface.

* * * * *